US008707537B2

(12) United States Patent
Clark

(10) Patent No.: US 8,707,537 B2
(45) Date of Patent: Apr. 29, 2014

(54) SYSTEM AND METHOD FOR SECURING DETACHABLE CONSTRUCTION EQUIPMENT

(76) Inventor: Donald E. Clark, Gloucester, MA (US)

( * ) Notice: Subject to any disclaimer, the term of this patent is extended or adjusted under 35 U.S.C. 154(b) by 0 days.

(21) Appl. No.: 13/337,965

(22) Filed: Dec. 27, 2011

(65) Prior Publication Data

US 2012/0180292 A1 Jul. 19, 2012

Related U.S. Application Data

(60) Provisional application No. 61/427,223, filed on Dec. 27, 2010.

(51) Int. Cl.
*E05B 17/00* (2006.01)
*E05B 17/20* (2006.01)

(52) U.S. Cl.
USPC ..... 29/525.01; 29/428; 70/58; 70/466; 280/507

(58) Field of Classification Search
USPC ..... 29/428, 11, 525.02, 525.03, 804; 70/466, 58, 34, 54–56, 258, 233–235
See application file for complete search history.

(56) References Cited

U.S. PATENT DOCUMENTS

| | | | | |
|---|---|---|---|---|
| 4,489,576 | A * | 12/1984 | Mullich et al. | 70/134 |
| 7,681,334 | B2 * | 3/2010 | LeBlond et al. | 37/231 |
| 2009/0066059 | A1 * | 3/2009 | Most et al. | 280/507 |

* cited by examiner

*Primary Examiner* — Alexander P Taousakis
(74) *Attorney, Agent, or Firm* — Guntin & Gust, PLC; Ralph Trementozzi

(57) ABSTRACT

A security lock assembly includes a channel blocking frame, deadbolt and a pin-lock assembly. The channel blocking frame defines a central opening along a first axis and a pair of opposing apertures along a second axis orthogonal to the first. The deadbolt also defines an aperture or bore extending therethrough for alignment with the frame's opposing apertures when positioned at least partially within the central opening of the channel blocking frame. The pin lock assembly has an elongated shaft dimensioned to extend through opposing apertures of the lock frame and deadbolt thereby entrapping the deadbolt within the channel blocking frame. Enlarged ends of the pin lock assembly prevent unauthorized removal of the pin-lock, the deadbolt, and thus the installed lock assembly from a detachable assembly (e.g., plow). The security lock assembly when secured within an attachment channel of a plow prevents unauthorized attachment without first removing the security lock assembly.

19 Claims, 14 Drawing Sheets

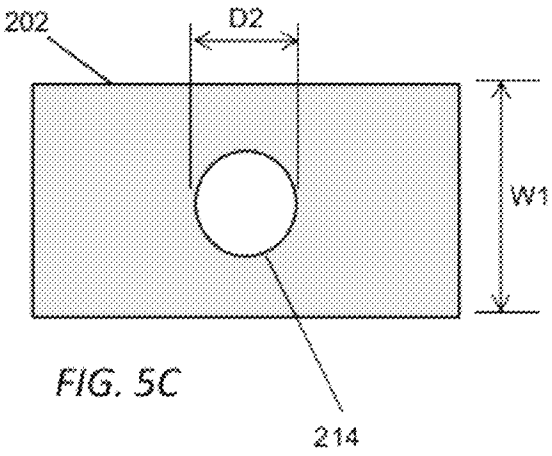
FIG. 5A
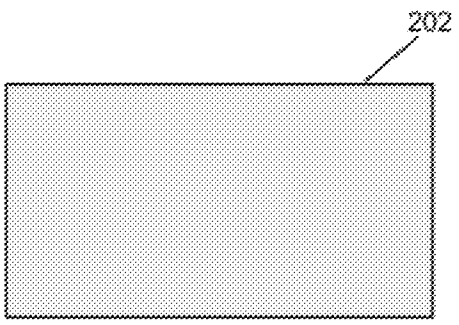
FIG. 5B
FIG. 5C
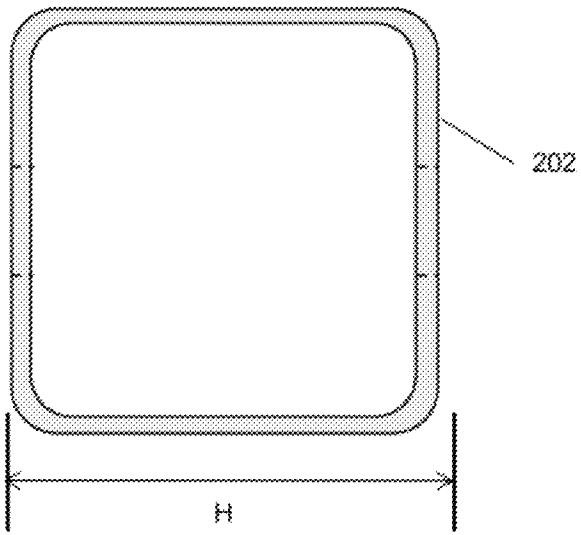
FIG. 5D

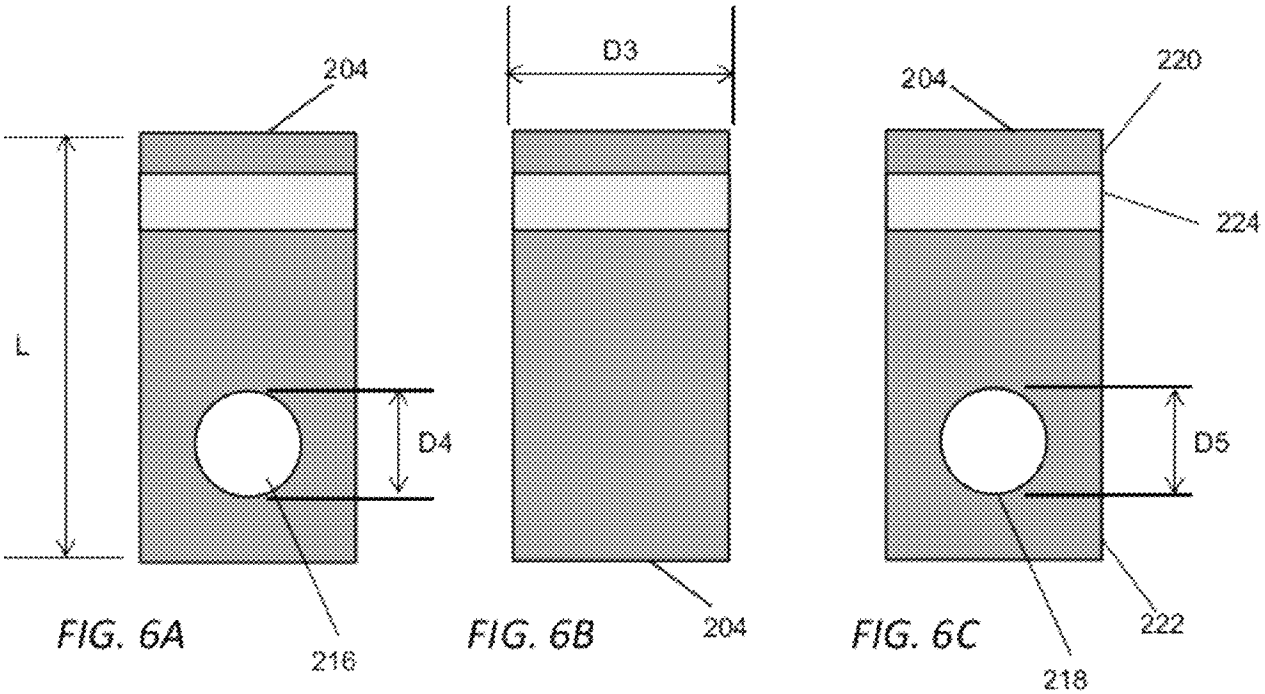
FIG. 6A
FIG. 6B
FIG. 6C
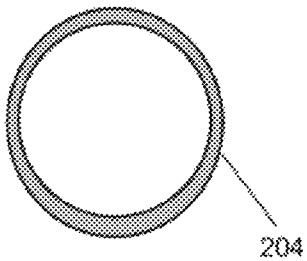
FIG. 6D

SYSTEM AND METHOD FOR SECURING DETACHABLE CONSTRUCTION EQUIPMENT

RELATED APPLICATIONS

This application claims the benefit of U.S. Provisional Application No. 61/427,223, filed Dec. 27, 2010. The entire teachings of the above application are incorporated herein by reference.

BACKGROUND

Detachable devices, such as snow plows, trailers, and the like, are often designed for ease of attachment and removal to a vehicle. For example, a snow plow assembly may include two extending arms dimensioned and positioned to engage opposing push plate extensions disposed on a vehicle. In particular, some of the extending arms have open channels into which the push plates can be inserted. In at least some instances, the plow assembly includes a fastening feature, such as retractable latch pins that are extendable to engage apertures in the push plate extensions. When extended therethrough, the latch pins engage, entrap or otherwise attach the plow to the vehicle, such that the plow can be transported with relative ease.

Some detachable devices, such as snow plows, are relatively expensive devices; whereas, the push plate extensions used to engage such devices are relatively inexpensive, being perhaps $1/10^{th}$ the cost of a plow. Thus, a thief could quickly and easily steal unattended equipment (e.g., snow plows) with a minimal investment of push plate extensions.

What is needed is a means to secure equipment, such as snow plow assemblies while left unattached to any vehicle to prevent unauthorized attachment and theft.

SUMMARY

It would be desirable to overcome the above mentioned shortcomings and drawbacks associated with the prior art.

Described herein are techniques for securing an unattached detachable device, such as a snow plow.

In one aspect, at least one embodiment described herein provides a security lock assembly, including a lock frame defining a central opening and further defining opposing apertures therethrough. The assembly also includes a deadbolt and a pin lock assembly. The deadbolt defines an aperture extending therethrough. The deadbolt is also dimensioned to extend at least partially within the central opening of the lock frame. The pin lock assembly has a removable end and an opposing end joined by an elongated shaft. The elongated shaft is dimensioned to extend through opposing apertures of the lock frame and deadbolt thereby entrapping the deadbolt within the locking frame.

In another aspect, at least one embodiment described herein provides a process for securing a detachable assembly. The process includes inserting a lock frame within an open channel of plow assembly protruding attachment arm. A portion of a deadbolt is placed through a latch pin receiving hole in the attachment arm. The lock frame is secured to the deadbolt to prevent travel of the deadbolt along its axis, thereby retaining at least a portion of the deadbolt within the latch pin receiving hole and retaining the lock frame within the open channel. A presence of the lock frame within the channel, blocks further attachment to the plow assembly protruding attachment arm. In some embodiments, the detachable assembly includes a plow blade.

In yet another aspect, at least one embodiment described herein provides an assembly for securing a plow. The assembly includes means for inserting a lock frame within an open channel of plow assembly protruding attachment arm. The assembly also includes means for placing a portion of a deadbolt through a latch pin receiving hole in the attachment arm. Means for securing the lock frame to the deadbolt are also included to prevent travel of the deadbolt along its axis, thereby retaining at least a portion of the deadbolt within the latch pin receiving hole and retaining the lock frame within the open channel. A presence of the lock frame within the channel, blocks further attachment to the plow assembly protruding attachment arm.

BRIEF DESCRIPTION OF THE DRAWINGS

The foregoing and other objects, features and advantages will be apparent from the following more particular description of the embodiments, as illustrated in the accompanying drawings in which like reference characters refer to the same parts throughout the different views. The drawings are not necessarily to scale, emphasis instead being placed upon illustrating the principles of the embodiments.

FIG. 5A through FIG. 5D are top, end, bottom and side views, respectively, of a channel blocking portion of the plow lock assembly shown in FIG. 3A and FIG. 3B.

FIG. 6A through FIG. 6D are top, end, bottom and side views, respectively, of a deadbolt portion of the plow lock assembly shown in FIG. 3A and FIG. 3B.

DETAILED DESCRIPTION

Figure 1:
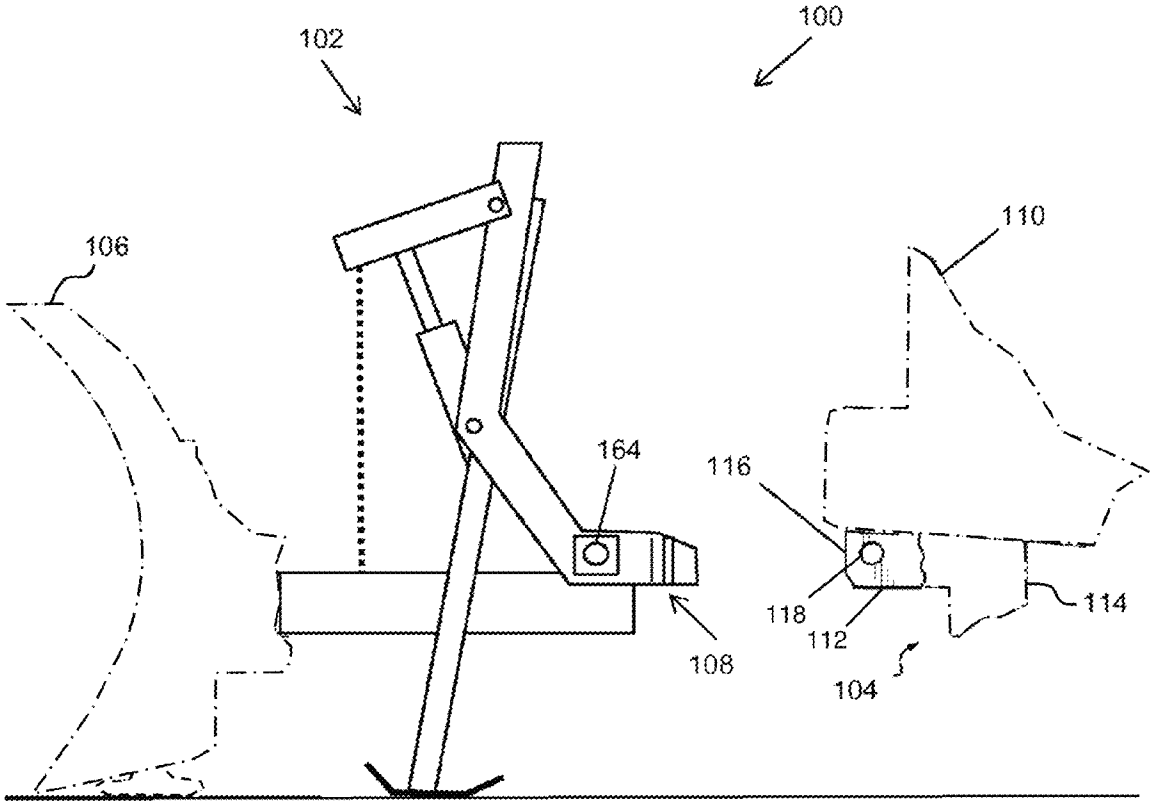
PRIOR ART FIG. 1
FIG. 1 is a side view of an example of a snow plow mounting assembly.

FIG. 1 is a side view of an example of a snow plow mounting assembly 100. The snow plow mounting assembly 100 includes a snow plow assembly 102 shown coupled to a plow blade 106 (shown in phantom) and a mount assembly 104 shown attached to a portion of a vehicle 110 (shown in phantom). The mount assembly 104 includes at least one forward protruding arm portion 112 for coupling to a vehicle 110 through a mount frame 114. The arm portion 112 includes a forward-facing push plate 116 and a latch-pin receiving hole 118. During coupling of a plow blade 106 to the vehicle 110, at least a portion of the forward protruding arm 112 is received within a plow assembly attachment arm 108. The plow assembly attachment arm 108 includes a retaining device, such as a retractable latch pin 164, that can be inserted through the latch pin receiving hole 118 to form an attachment between the snow plow assembly 102, including the plow blade 106 and the vehicle 110.

Figure 2:
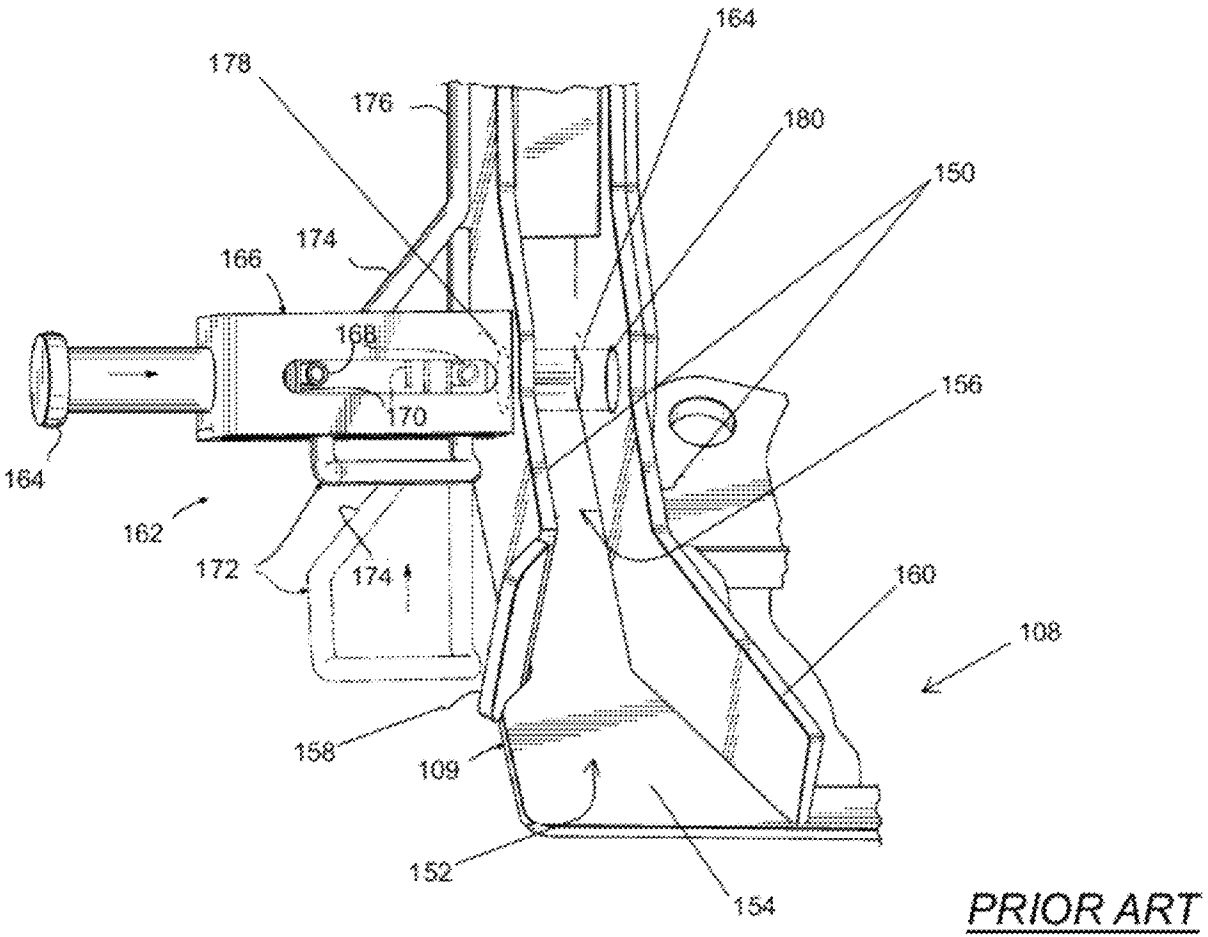
PRIOR ART FIG. 2
FIG. 2 is a perspective view, in more detail, of an example of a plow assembly attachment arm portion of the snow plow mounting assembly shown in FIG. 1.

FIG. 2 is a perspective view, in more detail, of an example of a plow assembly attachment arm portion 108 of the snow plow mounting assembly 100 shown in FIG. 1. The attachment arm portion 108 includes left and right sidewalls 150, substantially parallel and spaced apart. A bottom edge of each of the side walls 150 is attached to a floor portion 154, the combined sidewalls and floor portion defining an open receiving channel 156 therebetween. In the illustrative example, the left and right sidewalls 150 terminate in flared end portions 158, 160 at a vehicle facing end of the channel 156, forming an open end 152.

A latch mechanism 162 is securedly attached to one of the side walls 150. The latch mechanism 162 includes a latch pin 164 slideably engaged within a latch-pin mounting bracket 166. A guide pin 168 extends radially from a shaft of the latch pin 164, and is slideably retained within a guiding slot 169 defined within the mounting bracket 166. A spring 170 retained between an interior wall of the mounting bracket 166 and the pin 168 provides a biasing force urging the latch pin 164 toward the attachment arm 108. More particularly, the biasing force of the spring urges the latch pin 164 through a pass-through hole 178 of an adjacent one of the sidewalls 150. The latch pin 164 is configured to extend across the receiving channel 156 and in at least some embodiments, through an opposing side wall aperture 180. When the mount assembly arm 112 is positioned within the channel, such that the latch pin-receiving hole 118 is aligned between the pass through hole 174 and the side wall aperture 180, advancement of the latch pin 164 through the sidewall apertures 178, 180 secures the snow plow assembly 102 to the vehicle 110 (FIG. 1). In at least some embodiments, the snow plow assembly 102 includes two such attachment arm portions 108 (e.g., left and right), each adapted for removable coupling to a respective arm 112 of a mount assembly.

Figure 3B:
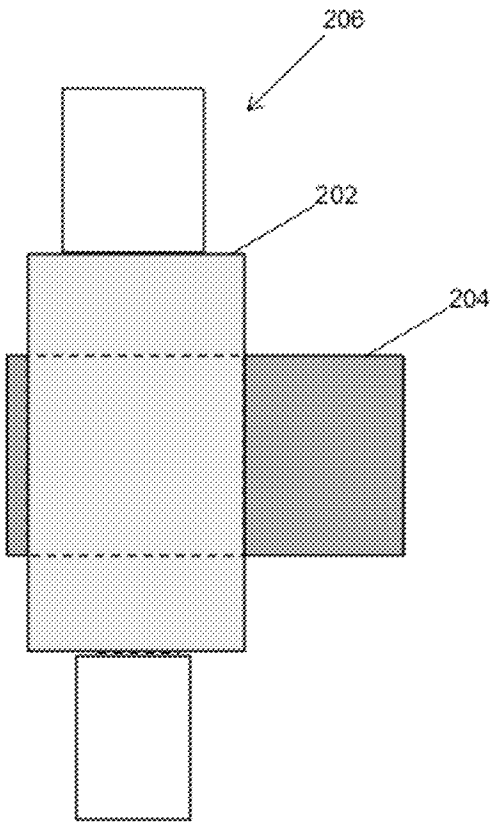
FIG. 3A and FIG. 3B are schematic diagrams of a side view and end view, respectively, of an example embodiment of a plow lock assembly.
Figure 3A:
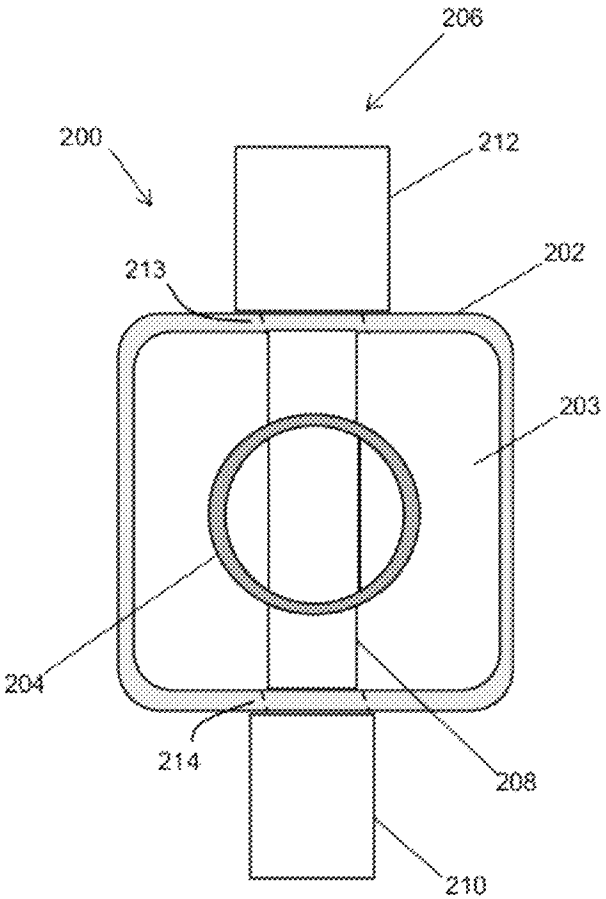

FIG. 3A and FIG. 3B are schematic diagrams of a side view and end view, respectively, of an example embodiment of a plow lock assembly 200. The plow lock assembly 200 includes a channel-blocking frame 202, a deadbolt 204 (e.g., an elongated rod or latch), and a pin-lock assembly 206. The pin-lock assembly 206, in turn, includes an elongated shaft 208, terminated at one end in a radially enlarged, or bulbous, end portion 210. A removable locking end, or lock body 212 is attachable at the other end of the elongated shaft 208. The lock body 212 is also dimensionally larger than a diameter of the elongated shaft 208. Such a pin-lock assembly 206 is sometimes referred to as a "locking hitch pin" lock, as may be used in automotive applications, for example, to secure towed devices, such as moving trailers, marine trailers, and the like. Examples of such pin-lock assemblies include pin tumbler locking no. 1480DAT, also referred to as a "stainless steel barbell lock" dimensioned for a ⅝ inch receiver opening, and no. 1472DAT for ½ inch receiver opening, each commercially available from Master Lock Company LLC of Oak Creek, Wis.

In the example plow lock assembly 200, the channel-blocking frame 202 includes a channel opening 203 extending from one side to the other. In these embodiments, the channel-blocking frame 202 is an enclosed square, defining a central channel opening 203 that is also square, following a contour of the channel-blocking frame 202. For example, the channel blocking frame 202 can be cut from hollowed square stock having a hollow interior. It is understood that other embodiments are possible in which, for example, the channel-blocking frame 202 is formed as another enclosed shape in cross-section, such as a rectangle, a triangle, and more generally as a polygon. Other cross sectional shapes are possible, such as a circles and an ellipses. For example, the channel-blocking frame 202 can be cut from cylindrical stock forming an enclosed circular cross section defining a circular opening. In some embodiments, the frame 202 is solid (e.g., cut from a solid stock) with a central aperture or bore formed therethrough, serving the purpose of the central channel opening 203.

The rod, latch, or deadbolt 204 is dimensioned and shaped to extend through the central opening 203 of the channel-blocking frame 202. In at least some embodiments, the deadbolt 204 is cylindrical in shape, having a circular shape in cross section. The deadbolt 204 can be solid or hollow. For example, the deadbolt 204 in the illustrative example is a hollow cylinder as may be formed from an elongated section of tubing. In at least some embodiments, at least a portion of the deadbolt 204 extends away from the central opening of the channel-blocking frame 202 when positioned relative thereto. In the illustrative example, a portion of the deadbolt 204 extends toward the right when viewed from one end, as shown.

Each of the channel-blocking frame 202 and the deadbolt 204 define respective bores therethrough. The bores are dimensioned and positioned along each of the frame 202 and the deadbolt 204, such that the elongated shaft 208 of the pin-lock assembly 206 can pass therethrough. Preferably, bores 213, 214 in the channel-blocking frame 202 are also dimensioned such that they provide interference to their respective ends of the pin-lock ("barbell") assembly 206, preventing travel of either end of the pin-lock assembly 206 through the channel-blocking frame 202. When assembled in this fashion, the deadbolt 204 is at least partially entrapped within the central opening of the channel-blocking frame 202, such that a portion of the deadbolt 204 extends away from the central opening 203 of the frame 202 as best illustrated in the end view shown in FIG. 3B.

Figure 4:
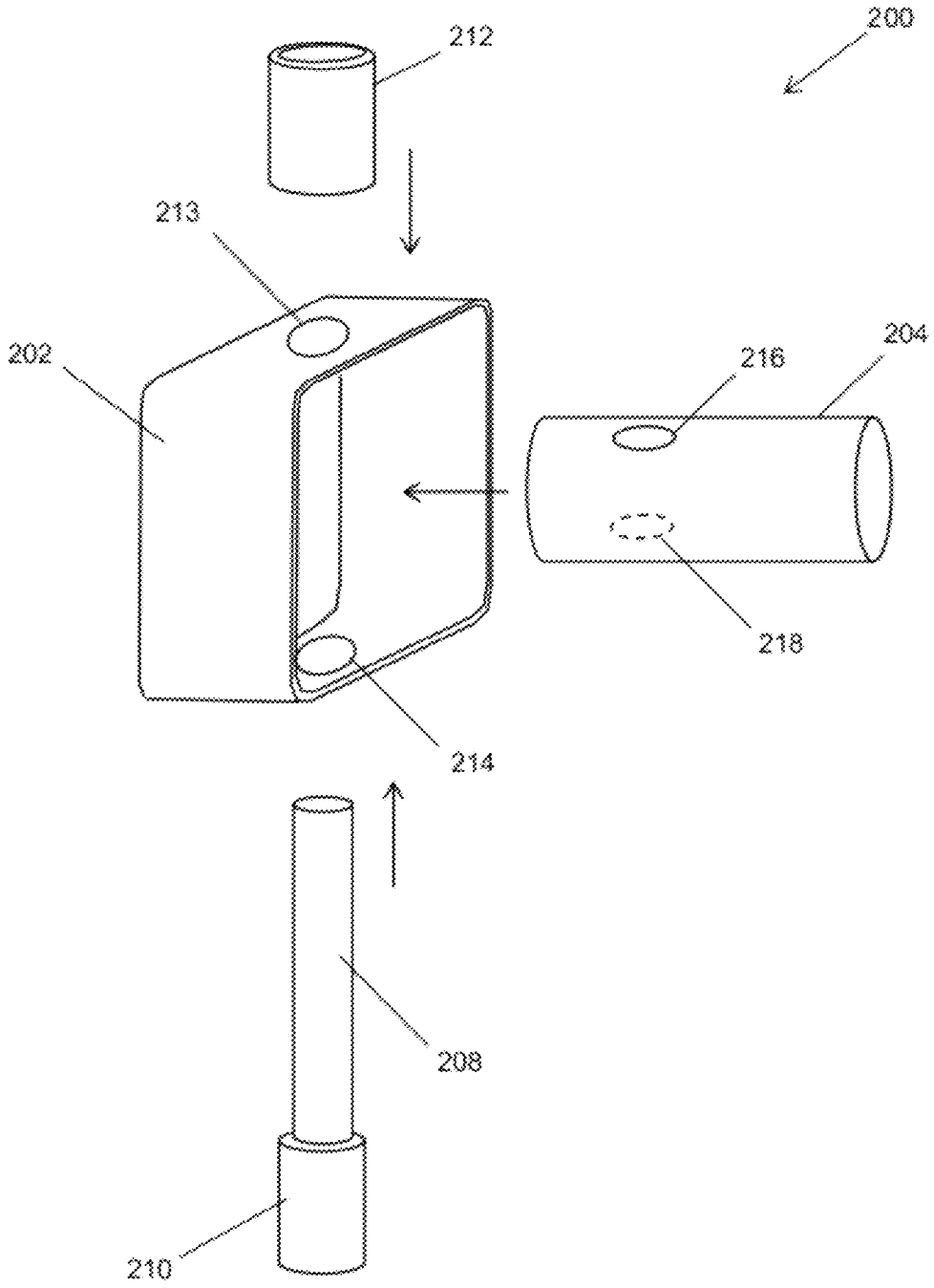
FIG. 4 is an exploded perspective view of the plow lock assembly shown in FIG. 3A and FIG. 3B.

FIG. 4 is an exploded perspective view of the plow lock assembly 200. In particular, a top aperture 213 and a bottom aperture 214 are observable along top and bottom portions of the channel-blocking frame 202, respectively. Also observable are top and bottom apertures 216, 218 along the deadbolt 204. All of the apertures are circular in the illustrative example, as the elongated shaft of the pin-lock assembly 206 is also cylindrical. It is conceivable that different shaped apertures 213, 214, 216, 218 can be provided, and that in at least some embodiments, the shape of the apertures 213, 214, 216, 218 need not be the same with respect to each other and with respect to a cross-sectional shape of the elongated shaft 208.

FIG. 5A through FIG. 5D are top, end, bottom and side views, respectively, of the channel blocking frame 202 of the plow lock assembly 200 shown in FIG. 3A and FIG. 3B. In the illustrative example, a diameter of the top aperture is D1 and a diameter of the bottom aperture is D2. In at least some embodiments, D1=D2. A width of the channel-blocking frame 202 is W1, and a length of one of the sides of the square frame is H. The diameters of the apertures are chosen to accommodate the elongated shaft 208, while blocking travel of either end 210, 212 of the pin-lock assembly 206 therethrough. Choices of the width W1 and length, or height H, can be dictated by a particular application as will be described in more detail below.

FIG. 6A through FIG. 6D are top, end, bottom and side views, respectively, of a deadbolt portion 204 of the plow lock assembly 200. In the illustrative example, a diameter of the top aperture is D4 and a diameter of the bottom aperture is D5. In at least some embodiments, D4=D5. A diameter of the deadbolt 204 is D3, and a length is L. Once again, the diameters of the apertures 216, 218 are chosen to accommodate the elongated shaft 208. Choices of the deadbolt diameter D3 and length L can be dictated by a particular application as will be described in more detail below.

In some embodiments, at least a portion of an outer surface of the deadbolt 204 includes a grip-enhancing feature. Such grip enhancing feature can include a knurled or otherwise abrasive finish 224. Alternatively or in addition, the grip-enhancing feature can include a protrusion, such as a knob. In some embodiments, such a grip 224 can be fashioned by machining or casting, for example, during fabrication of the deadbolt 204. Alternatively or in addition, such a grip 224 can be applied separately to the deadbolt 204, for example, using an adhesive or other suitable mechanical fastener.

Figure 7:
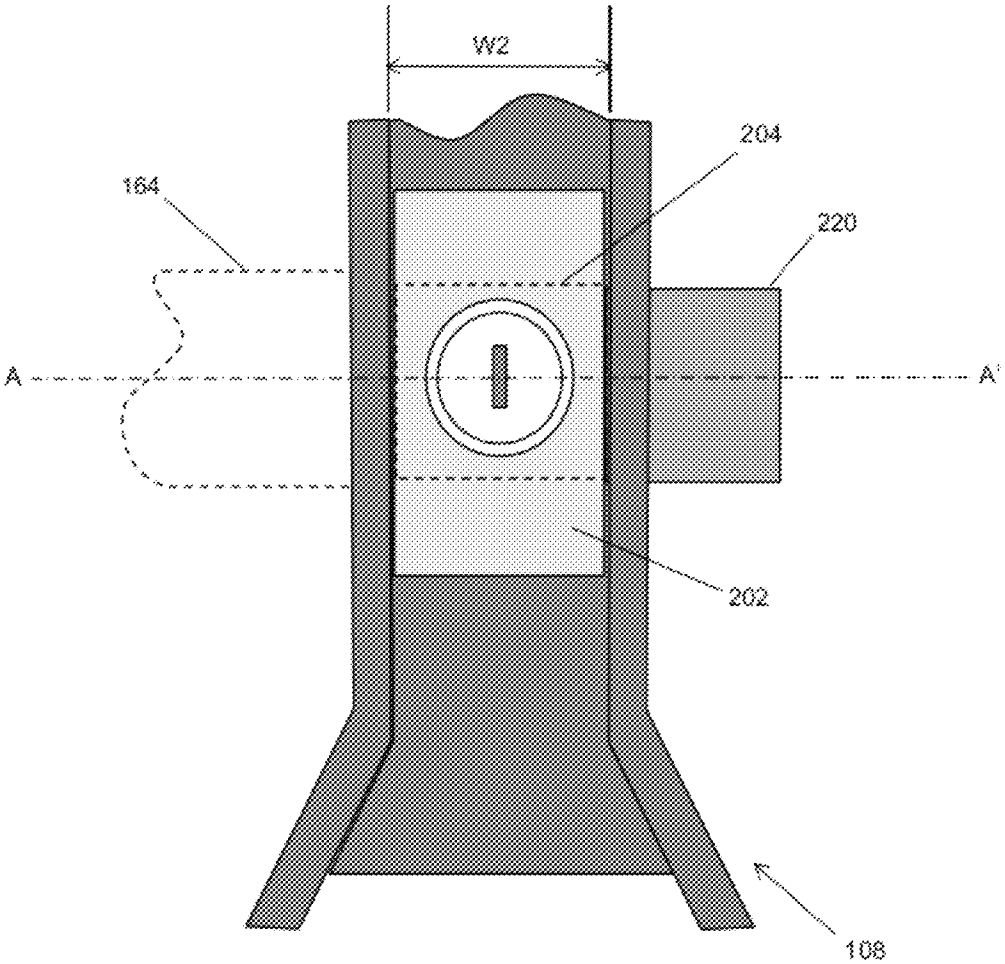
FIG. 7 is a top view of the plow lock assembly shown in FIG. 3A and FIG. 3B secured within the plow assembly attachment arm portion shown in FIG. 2.

FIG. 7 is a top view of the example embodiment of the plow lock assembly 200 secured within one of the plow assembly attachment arm 108 portions (FIG. 2). Generally, using one plow lock assembly 200, even in detachable devices having more than one attachment arm portions 108, will be a sufficient deterrent to theft. The channel-blocking frame 202 is positioned substantially within an open receiving channel 156 (FIG. 2) of the attachment arm 108. The central opening of the channel-blocking frame 202 is positioned and aligned to allow travel of the latch pin 164 therethrough, though the latch pin 164 is preferably in a retracted or otherwise open position when secured by the lock assembly 200. The deadbolt 204 is positioned such that the end extending away from the channel-blocking frame 202 extends through the sidewall aperture 180 (FIG. 2), with the other end extending through the central opening of the channel-blocking frame 202. The top and bottom apertures 216, 218 of the deadbolt 204 are aligned with top and bottom apertures 213, 214 or the channel-blocking frame 202. The pin-lock assembly 206 is positioned to engage each of the channel-blocking frame 202 and the deadbolt 204 as described above, extending through the aligned apertures 216, 218, 213, 214. Coupling by the pin-lock assembly 206 generally prevents movement of the deadbolt 204 with respect to a cross-sectional plane of the frame 202. Placement of the protruding end 220 of the deadbolt 204 through the sidewall aperture 118 preferentially aligns the deadbolt 204 along a travel axis of the latch pin 164.

In at least some embodiments, the diameter D3 of the deadbolt 204 is equal to or less than a diameter of the latch pin 164, such that the deadbolt 204 provides interference, otherwise blocking travel of the latch pin 164 into the open channel of the attachment arm 108. In at least some embodiments, the width W1 of the channel-blocking frame 202 is slightly less than a width W2 of the open channel of the attachment arm 108. A tight tolerance ensures a snug fit of the channel-blocking frame 202 within the open channel preventing passage of a blade or cutting implement therebetween.

Figure 8:
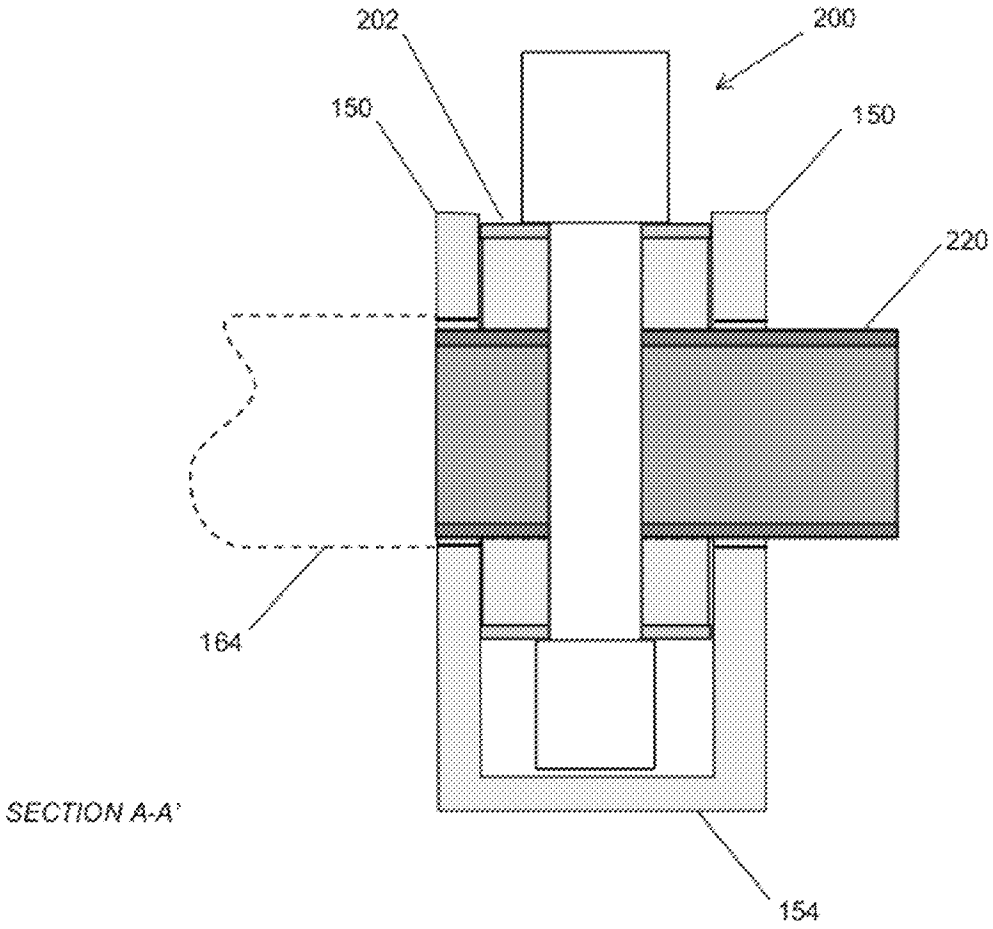
FIG. 8 is a cross-sectional view of the secured plow lock assembly shown in FIG. 7.

FIG. 8 is a cross-sectional view of the secured plow lock assembly shown in FIG. 7. As readily observable, a height H of the channel-blocking frame 202 is selected such that the frame 202 resides substantially within the open channel of the receiving arm 108 (i.e., not extending above a top of either side wall 150). In at least some embodiments, no portion of the frame extends above or otherwise beyond the open channel when secured to the attachment arm 108. Ensuring proper dimensions, such that the frame 202 remains within the open channel when installed, prevents or otherwise blocks access to any blade or other cutting implement.

Figure 9B:
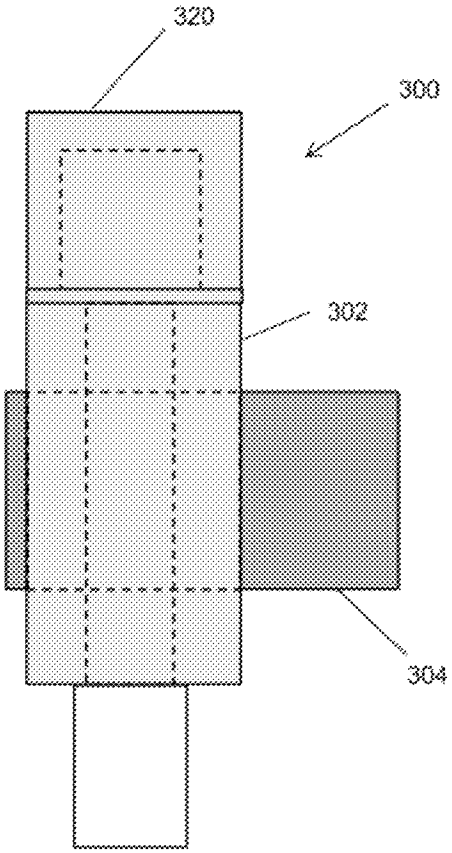
FIG. 9A and FIG. 9B are schematic diagrams of a side view and end view, respectively, of an example of an alternative embodiment of a plow lock assembly.
Figure 9A:
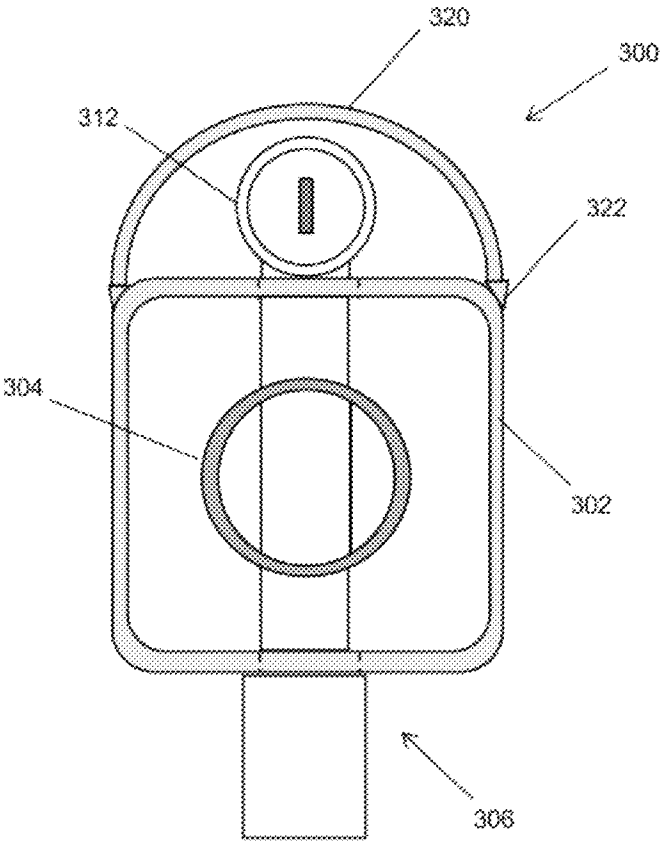

FIG. 9A and FIG. 9B are schematic diagrams of a side view and end view, respectively, of an example of an alternative embodiment of a plow lock assembly 300. In this example, a shield or shroud 320 is provided at a top side of the channel-blocking frame 302. Preferably, the shroud 320 is dimensioned to extend over and otherwise block access to at least a portion of a lock body 312 of a pin-lock assembly 306. As shown, the shroud 320 can be formed as an arch or inverted "U," being attached at either end to the frame 302. Such attachment can be formed by a securable means, such as a weld 322. A side opening of the shroud 320 allows access to a key-accepting surface of the lock body 312 to allow for authorized (e.g., keyed) access, while prohibiting unauthorized access (e.g., cutting blades and the like).

Figure 10B:
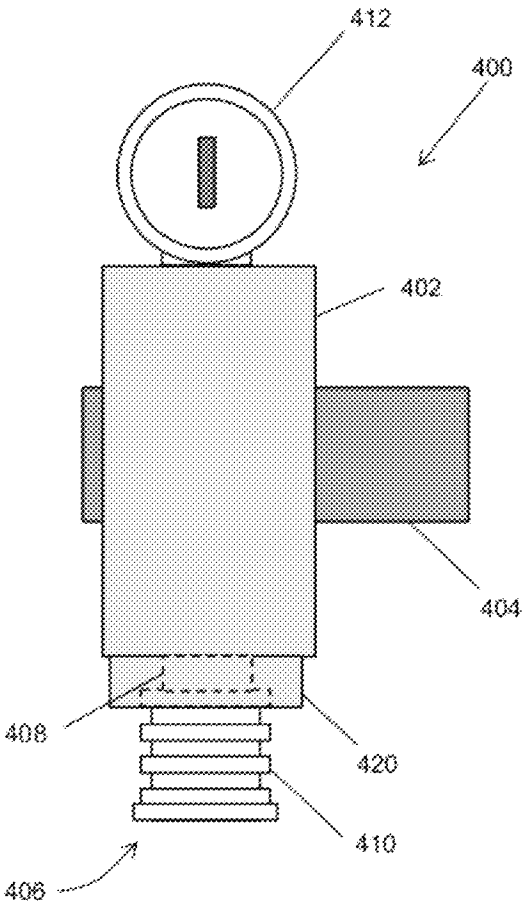
FIG. 10A and FIG. 10B are schematic diagrams of a side view and end view, respectively, of an example of another alternative embodiment of a plow lock assembly.
Figure 10A:
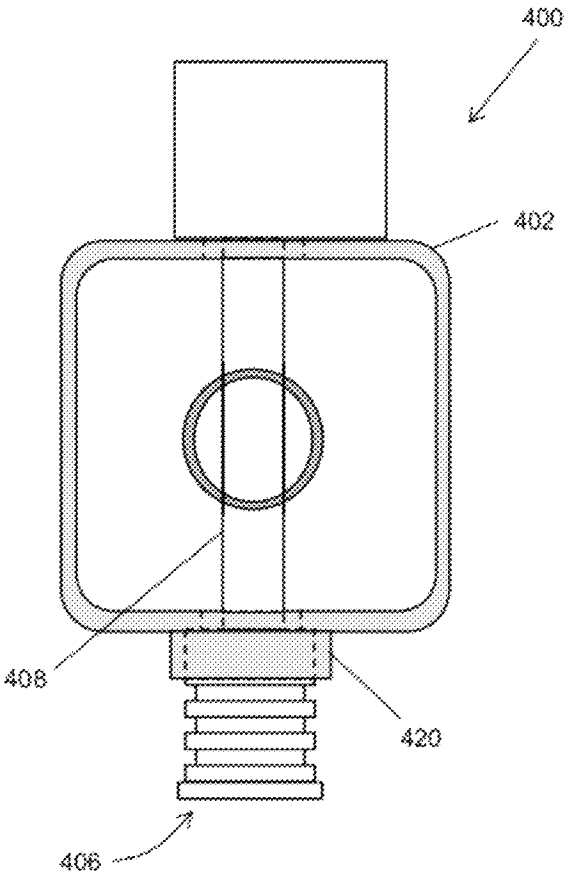

FIG. 10A and FIG. 10B are schematic diagrams of a side view and end view, respectively, of an example of another alternative embodiment of a plow lock assembly 400. In this embodiment, a collar shield 420 is provided along at least one of the top and bottom sides of the channel-blocking frame 402 (illustrated at the bottom side). The collar shield 420 can be positioned to surround an exposed portion of the pin-lock assembly 406, such as a one or more of a bottom end of the elongated shaft 408, and the bottom, bulbous end 410 of the pin-lock assembly 406. In at least some embodiments, the collar shield 420 can be entrapped between the bulbous end 410 and a bottom surface of the frame 402, or fastened to the frame 402, for example by welding, soldering, and/or chemical adhesive, and/or by a mechanical fastening arrangement, such as a threaded engagement.

Figure 11B:
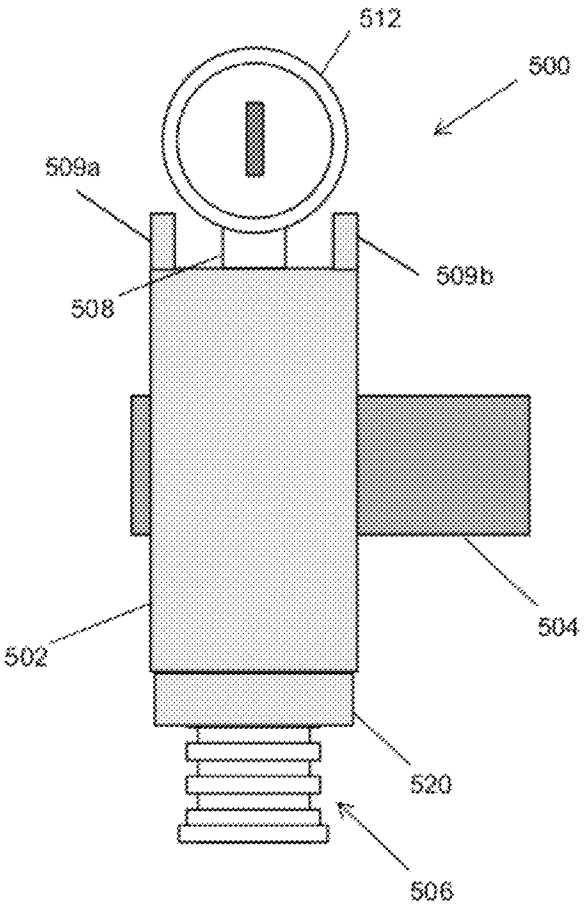
FIG. 11A and FIG. 11B are schematic diagrams of a side view and end view, respectively, of an example of another alternative embodiment of a plow lock assembly.
Figure 11A:
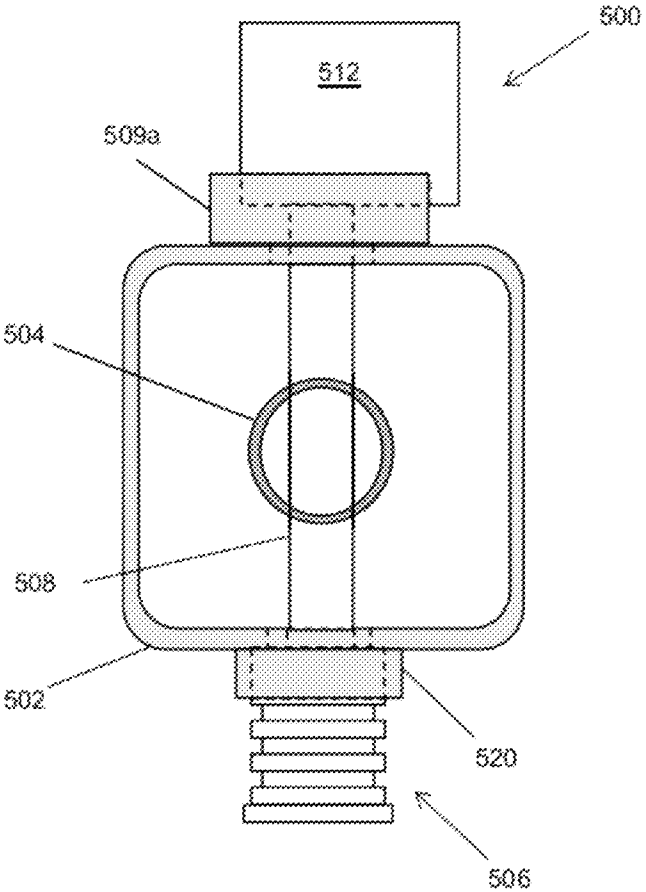

FIG. 11A and FIG. 11B are schematic diagrams of a side view and end view, respectively, of an example of yet another alternative embodiment of a plow lock assembly 500. The illustrative example includes a first collar shield 520 at one end and a second collar shield 522 at another end of the channel-blocking frame 502. In this example, the second collar shield 522 includes at least two parallel wall sections 509*a*, 509*b* (generally 509). The wall sections 509 extend upward from a top surface of the channel-blocking frame 502, positioned along opposite sides of an exposed portion of an elongated shaft 508 of a pin-lock assembly 506. In the example embodiment, the walls extend upward for a height that is sufficient to cover any exposed portion of the shaft 508. In such a configuration the walls 509 prevent unauthorized access (e.g., by a cutting blade) to at least any exposed portion of the shaft 508. The walls 509 can be attached to the top surface of the frame 502 by any suitable secure technique, such as a weld. Alternatively or in addition, one or more of the wall sections 509 can be formed integrally with the channel-blocking frame 502, for example, by bending protrusions (e.g., tabs) upward that are formed within the top portion of the frame 502.

Figure 11D:
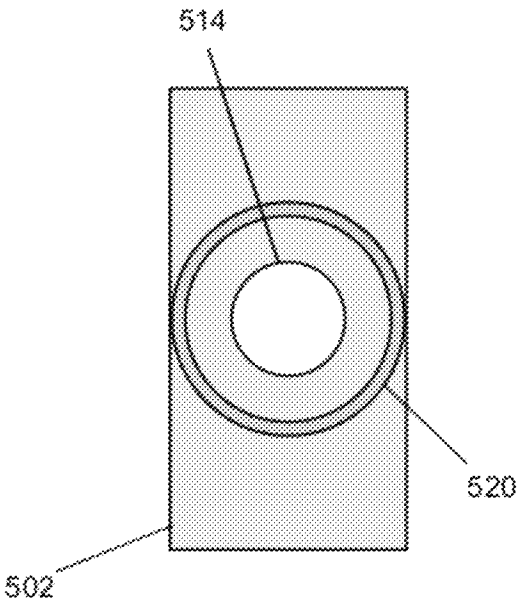
FIG. 11C and FIG. 11D are schematic diagrams of a top view and bottom view, respectively, of the plow lock assembly shown in FIG. 11A and FIG. 11B.
Figure 11C:
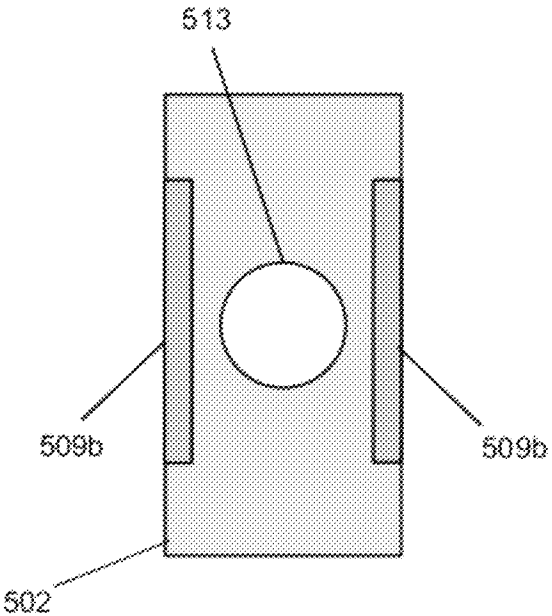

A top view of the channel-blocking frame 502 is shown in FIG. 11C. Each wall section can extend for a length along the top surface of the frame 502, as shown. The length can be a full length of the top surface, or a shorter length, provided that the wall sections 509 provide at least some blockage to an elongated shaft 508 of the pin lock 506 when inserted through the top hole 513. Alternatively or in addition, one or more wall sections can be provided along the top surface of the frame 502, but not necessarily parallel with any edges of the frame 502.

A bottom view of the channel blocking frame 502 is shown in FIG. 11D. The circumferential collar shield 520 is shown encircling the bottom aperture 514. Preferably, the collar shield 520 extends for a sufficient height above a bottom surface of the frame 502 to prevent unauthorized access (e.g., by a cutting blade) to the bottom portion of a pin-lock assembly 506 when inserted therethrough. The collar shield 520 can be attached to the frame 520 by any suitable means, such as by a weld, or a mechanical fastener, such as a threaded engagement.

Including one or more of the shrouds and collar shields add further measures to prevent compromise of the lock assembly when deployed. Preferably the lock assembly is made from a hardened material that is difficult to break, drill, or cut through. Such materials include metals, and particularly hardened metals, such as steel, stainless steel, tungsten and the like.

Placement of one locking assembly in one of the two or more attachment arms 108 of a detachable device, such as the example the snow plow assembly 102, is generally sufficient to prevent unauthorized attachment of the snow plow assembly 102 to a mount assembly of a vehicle. As such, it provides a substantial deterrent to theft. Beneficially, the lock assembly is small, and relatively simple and inexpensive. For example, the lock assembly can be stored in a glove box or other suitable cabin compartment of a vehicle, ready to be deployed when a plow is removed from the vehicle. It is not necessary that the lock assembly be used exclusively with snow plows. It is also conceivable that such a lock assembly can be used with other detachable devices, such as construction equipment, trailers, and the like.

Figure 12B:
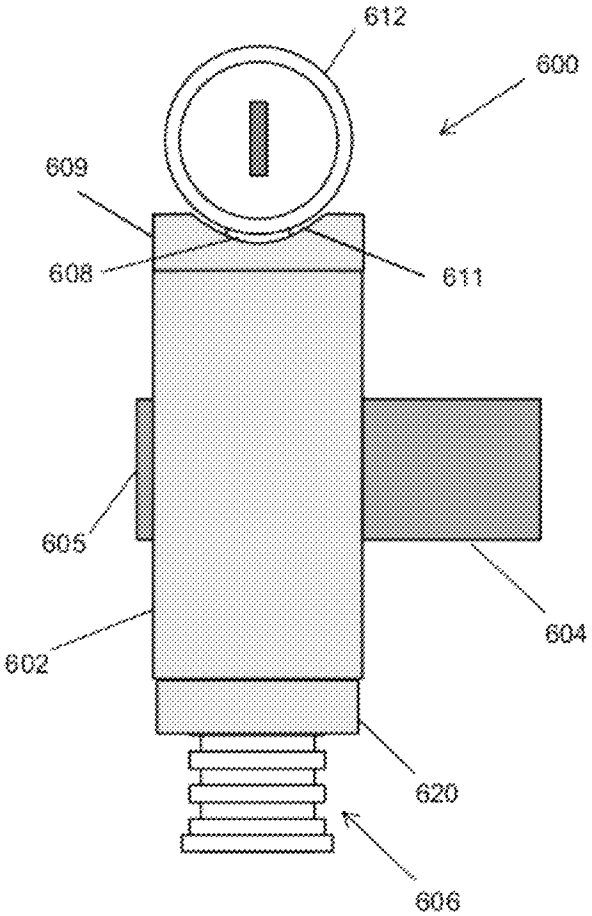
FIG. 12A and FIG. 12B are schematic diagrams of a side view and end view, respectively, of an example of yet another alternative embodiment of a plow lock assembly.
Figure 12A:
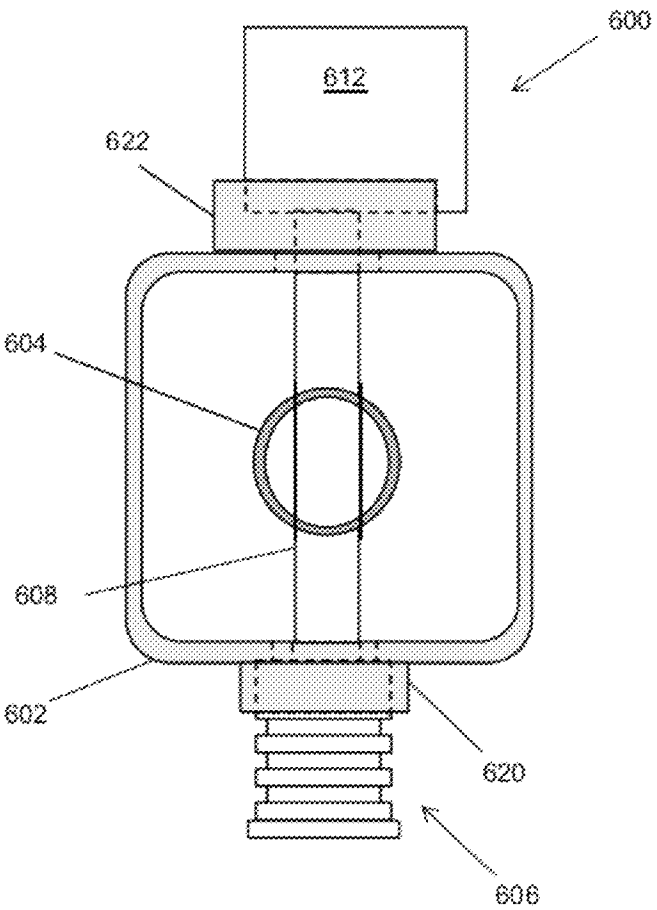

FIG. 12A and FIG. 12B are schematic diagrams of a side view and end view, respectively, of an example of yet another alternative embodiment of a plow lock assembly 600. The illustrative example includes a first collar shield 620 at one end and a second collar shield 622 at another end. In this example, the second collar shield 622 includes a circumferential wall section 609. The wall section 609 extends upward from a top surface of a channel-blocking frame 602. In the example embodiment, the wall extends upward for a height that is sufficient to cover any exposed portion of the shaft 608. In such a configuration the wall 609 prevents unauthorized access (e.g., by a cutting blade) to at least any exposed portion of the shaft 608. The wall 609 can be attached to the top surface of the frame 602 by any suitable secure technique, such as a weld. As shown, the dead bolt 604 when engaged by the pin-lock assembly 606, protrudes 605 at least slightly from at least one side of the channel-blocking frame 602. Such a protrusion 605 can be sufficient to extend through an adjacent wall 150 of an attachment arm 108 (e.g., FIG. 2) when mounted therein, to prevent a locking pin 164 from penetrating any portion of the wall 150.

Figure 12D:
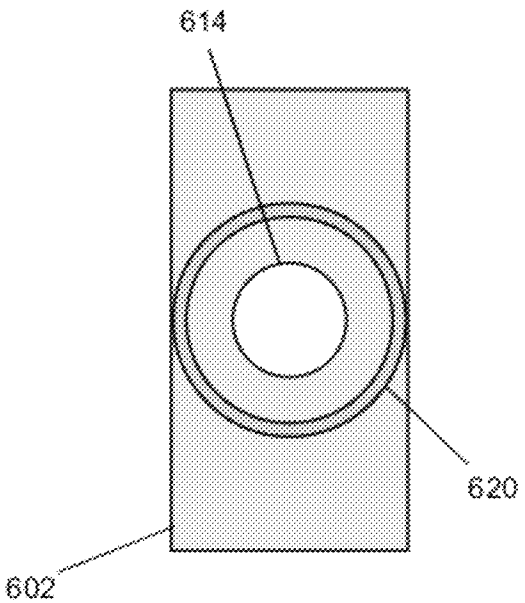
FIG. 12C and FIG. 12D are schematic diagrams of a top view and bottom view, respectively, of the plow lock assembly shown in FIG. 12A and FIG. 12B.
Figure 12C:
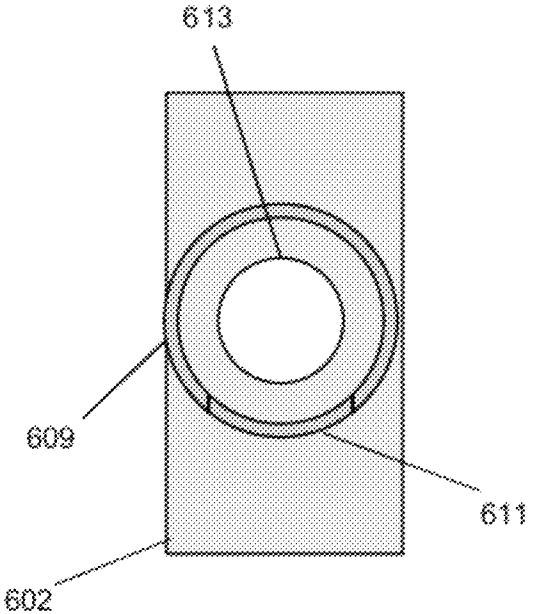

A top view of the channel-blocking frame 602 is shown in FIG. 12C. The wall 609 can extend forming an enclosed circle, as shown. A top portion 611 of the wall 609 can be contoured, for example, to accommodate an overlapping portion of the pin-lock assembly 606 (see also FIG. 12B).

A bottom view of the channel blocking frame 602 is shown in FIG. 12D. The circumferential collar shield 620 is shown encircling the bottom aperture 614. Preferably, the collar shield 620 extends for a sufficient height above a bottom surface of the frame 602 to prevent unauthorized access (e.g., by a cutting blade) to the bottom portion of a pin-lock assembly 606 when inserted therethrough. The collar shield 620 can be attached to the frame 620 by any suitable means, such as by a weld, or a mechanical fastener, such as a threaded engagement. Although different features are described as being used as collar shields in the example embodiments, described herein, it is understood that any combination of such collar shields can be used in various combinations. Thus, each channel-blocking frame can be configured with one or more collar shields (e.g., along a top surface, a bottom surface, or both top and bottom surfaces). Each of the collar shields can be similar or different according to any of the collar shields described herein, and equivalents thereto.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

What is claimed is:

1. A security lock assembly, comprising:

a lock frame that when positioned within an open channel of an attachment arm of a detachable assembly prevents insertion of a push plate between opposing side walls of the open channel, thereby preventing mounting of the detachable assembly to a vehicle, wherein the lock frame comprises an enclosed peripheral wall comprising first and second apertures on opposing sides of the enclosed peripheral wall, wherein the enclosed peripheral wall further comprises outer edges that abut inter surfaces of the opposing side walls;

an elongated deadbolt extending along a longitudinal axis and defining a lateral bore transverse to the longitudinal axis, the elongated deadbolt dimensioned to extend beyond an edge of the enclosed peripheral wall when positioned within an interior aperture of the lock frame when the lateral bore is aligned with the first and second apertures of the enclosed peripheral wall; and a pin lock assembly having a removable locking end and an opposing end joined by an elongated shaft, the elongated shaft dimensioned to simultaneously extend through first and second apertures of the lock frame and the lateral bore of the elongated deadbolt thereby entrapping the elongated deadbolt within the locking frame, wherein the elongated deadbolt extends beyond the enclosed peripheral wall to engage a side wall aperture of one of the opposing side walls the attachment arm to prevent removal of the lock frame from the open channel.

2. The security lock assembly of claim 1, further comprising a collar shield disposed along an outer surface of the peripheral wall with respect to the interior aperture and adjacent to one of the first and second apertures of the lock frame.

3. The security lock assembly of claim 2, wherein the collar shield comprises a wall section arranged to block access to at least a portion of the pin lock assembly when positioned within the lock frame.

4. The security lock assembly of claim 3, wherein the wall section is straight.

5. The security lock assembly of claim 3, wherein the wall section is an annular wall section.

6. The security lock assembly of claim 5, further comprising a contour provided along a top of the annular wall section, wherein the contour accommodates at least a portion of the pin lock assembly when positioned within the lock frame.

7. The security lock assembly of claim 1, wherein one of the lock frame, the deadbolt, or a combination thereof are formed from a hardened material.

8. The security lock assembly of claim 7, wherein the hardened material is selected from a group consisting of steel, stainless steel, tungsten, iron and combinations thereof.

9. The security lock assembly of claim 1, wherein the enclosed peripheral wall extends between the opposing side walls of the open channel of the detachable assembly mounting arm wherein the lock frame, when positioned within the open channel leaves a narrow gap between the lock frame and interior surfaces of either side wall of the opposing side walls of the open channel that is narrower than a width of a metal cutting blade, the narrow gap preventing insertion of the metal cutting blade therebetween.

10. A method for securing a plow, comprising:

inserting a lock frame between opposing side walls of an open channel of an attachment arm of a plow assembly, wherein the open channel of the attachment arm is configured to receive a push plate of a vehicular attachment to secure the plow assembly to a vehicle, wherein the lock frame comprises an enclosed peripheral wall defining an interior aperture, wherein the enclosed peripheral wall comprises first and second apertures aligned on opposing sides of the peripheral wall, wherein the enclosed peripheral wall further comprises outer edges that abut the opposing side walls, such that the lock frame, when positioned within the open channel of the attachment arm, extends from an interior surface of one side wall to an interior surface of an opposite side wall of the opposing side walls;

aligning the interior aperture of the lock frame with a latch pin receiving hole in one of the opposing side walls of the attachment arm, wherein the latch pin receiving hole is configured to receive a latch pin extending through the push plate of the vehicular attachment to secure the plow assembly to the vehicle;

placing a first portion of an elongated deadbolt extending along a longitudinal axis through the latch pin receiving hole;

placing a longitudinally separated second portion of the elongated deadbolt within the interior aperture of the lock frame, wherein the elongated deadbolt comprises a lateral bore transverse to the longitudinal axis;

aligning the lateral bore with the first and second apertures of the enclosed peripheral wall of the lock frame; and positioning an elongated pin to extend through the first and second apertures of the enclosed peripheral wall of the lock frame and the lateral bore of the elongated deadbolt to prevent travel of the elongated deadbolt along its longitudinal axis, thereby retaining at least a portion of the elongated deadbolt within the latch pin receiving hole, thereby retaining the lock frame within the open channel of the attachment arm, presence of the lock frame within the open channel preventing receiving of the push plate of the vehicular attachment within the open channel of the attachment arm, thereby blocking attachment of the attachment arm of the plow assembly to the vehicle.

11. The method of claim 10, further comprising securing the elongated pin with respect to the lock frame using a pin-lock assembly.

12. The method of claim 10, wherein the plow assembly comprises a plow blade.

13. A security lock assembly, comprising:

means for inserting a lock frame between opposing side walls of an open channel of an attachment arm of a plow assembly, wherein the open channel of the attachment arm is configured to receive a push plate of a vehicular attachment to secure the plow assembly to a vehicle, wherein the lock frame comprises an enclosed peripheral wall defining an interior aperture, wherein the enclosed peripheral wall comprises first and second apertures aligned on opposing sides of the peripheral wall, wherein the enclosed peripheral wall further comprises outer edges that abut the opposing side walls, such that the lock frame, when positioned within the open channel of the attachment arm, extends from an interior surface of one side wall to an interior surface of an opposite side wall of the opposing side walls;

means for aligning the interior aperture of the lock frame with a latch pin receiving hole in one of the opposing side walls of the attachment arm, wherein the latch pin receiving hole is configured to receive a latch pin extending through the push plate of the vehicular attachment to secure the plow assembly to the vehicle;

means for placing a first portion of an elongated deadbolt extending along a longitudinal axis through the latch pin receiving hole;

means for placing a longitudinally separated second portion of the elongated deadbolt within the interior aperture of the lock frame, wherein the elongated deadbolt comprises a lateral bore transverse to the longitudinal axis;

means for aligning the lateral bore with the first and second apertures of the enclosed peripheral wall of the lock frame; and means for positioning an elongated pin to extend through the first and second apertures of the enclosed peripheral wall of the lock frame and the lateral bore of the elongated deadbolt to prevent travel of the elongated deadbolt along its longitudinal axis, thereby retaining at least a portion of the elongated deadbolt within the latch pin receiving hole, thereby retaining the lock frame within the open channel of the attachment arm, presence of the lock frame within the open channel preventing receiving of the push plate of the vehicular attachment within the open channel of the attachment arm, thereby blocking attachment of the attachment arm of the plow assembly to the vehicle.

14. The method of claim 10, wherein the enclosed peripheral wall extends between the opposing side walls of the open channel of the plow assembly mounting arm wherein the lock frame, when positioned within the open channel leaves a gap between the lock frame and the interior surfaces of either side wall of the opposing side walls of the open channel that is insufficient to accommodate insertion of a metal cutting blade therebetween.

15. The method of claim 10, wherein the inserting the lock frame between opposing side walls of an open channel of the attachment arm comprises inserting hardened material is selected from a group consisting of steel, stainless steel, tungsten, iron and combinations thereof.

16. The method of claim 10, further comprising securing the elongated pin with respect to the lock frame using a pin-lock assembly.

17. The method of claim 10, further comprising securing the elongated pin with respect to the lock frame using a pin-lock assembly.

18. The method of claim 17, wherein securing the elongated pin comprises engaging a locking portion to one end of the elongated pin, wherein the locking portion is positioned within a collar shield disposed along an outer surface of the peripheral wall with respect to the interior aperture and adjacent to one of the first and second apertures of the lock frame.

19. The security lock assembly of claim 1, wherein the detachable assembly comprises a plow assembly.

* * * * *